US007388559B1

(12) United States Patent
Kim

(10) Patent No.: US 7,388,559 B1
(45) Date of Patent: Jun. 17, 2008

(54) REFLECTOR ANTENNA

(75) Inventor: Yong U. Kim, Bellflower, CA (US)

(73) Assignee: The Boeing Company, Chicago, IL (US)

( * ) Notice: Subject to any disclaimer, the term of this patent is extended or adjusted under 35 U.S.C. 154(b) by 11 days.

(21) Appl. No.: 11/614,467

(22) Filed: Dec. 21, 2006

(51) Int. Cl.
*H01Q 1/36* (2006.01)

(52) U.S. Cl. ..... 343/895; 343/840; 343/781 P; 343/912

(58) Field of Classification Search ..... 343/895, 343/840, 781 P, 912
See application file for complete search history.

(56) References Cited

U.S. PATENT DOCUMENTS 3,184,747 A * 5/1965 Kach ..... 343/840
4,742,359 A * 5/1988 Ishino et al. ..... 343/895
5,309,167 A * 5/1994 Cluniat et al. ..... 343/840
5,444,455 A * 8/1995 Louzir et al. ..... 343/895
5,774,095 A * 6/1998 Louzir ..... 343/895
6,861,998 B2 * 3/2005 Louzir et al. ..... 343/781 P

OTHER PUBLICATIONS

C. C. Kilgus, "Multi-element fractional turn helices," Antennas and Propagation, IEEE Transactions, vol. AP-16, pp. 499-501, Jul. 1968.
C. C. Kilgus, "Shaped conical radiation pattern of the backfire quadrifilar Helix," Antennas and Propagation, IEEE Transactions, vol. AP-23, pp. 392-397, May 1975.
H. Nakano, et al "Backfire radiation from a monofilar helix with a small ground plane," Antennas and Propagation, IEEE Transactions, vol. AP-36, pp. 1359-1364, Oct. 1988.

* cited by examiner

*Primary Examiner*—Hoang V Nguyen
(74) *Attorney, Agent, or Firm*—Klein, O'Neill & Singh, LLP

(57) ABSTRACT

An antenna provided. The antenna includes an outer dish having a first surface and a second surface; an inner dish mounted to the first surface of the outer dish; a helix feed mounted on a ground plane; and a support mounted at an axial center of the inner dish for supporting the ground plane.

22 Claims, 12 Drawing Sheets

| Feed Specification and Dimensions | |
|---|---|
| Operating frequencies: L1-L5 | |
| Type: Monofilar Helix | |
| Winding Rotation: CCW | |
| Direction of Radiation: Backward | |
| Radiation Polarization: LHCP | |
| Helix Diameter (in) | 2.30 |
| No. of Helical Turns | 7 |
| Pitch Angel (deg) | 14 |
| Spacing bw Turns (in) | 1.79 |
| Circumference (in) | 7.22 |
| Helix Length (in) | 12.54 |
| Wire Diameter (in) | 0.17 |
| Ground Plane Dia (in) | 2.07 |

REFLECTOR ANTENNA

CROSS REFERENCE TO RELATED APPLICATIONS

NONE

BACKGROUND

Field of the Disclosure

This disclosure relates generally to antennas and more particularly, to a reflector antenna specialized in producing a shaped beam.

BACKGROUND OF THE DISCLOSURE

A conventional Global Positioning System (GPS) satellite uses an L-Band antenna array to transmit a shaped beam on the earth. The beam is shaped to provide a signal of uniform strength to all exposed portions on the earth. The conventional GPS antenna array antenna, with multiple elements fed by a complex power distribution network, is costly to fabricate. Therefore, what is needed is a reflector based antenna design that can deliver equal or better performance than a conventional array antenna at a fraction of the cost.

SUMMARY OF THE DISCLOSURE

In one aspect of the disclosure, an antenna is provided. The antenna includes an outer dish having a first surface and a second surface; an inner dish mounted to the first surface of the outer dish; a helix feed mounted on a ground plane; and a support mounted at an axial center of the inner dish for supporting the ground plane.

In a second aspect of the disclosure, a method for shaping an antenna beam is provided. The method includes producing a first beam having a first phase angle, wherein the first beam is generated from signals reflected off an inner dish of a reflector antenna; producing a second beam having a second phase angle, wherein the second beam is generated from signals reflected off an outer dish; and superimposing the second beam onto the first beam resulting in an M-shaped beam pattern.

This brief summary has been provided so that the nature of the disclosure may be understood quickly. A more complete understanding of the disclosure may be obtained by reference to the following detailed description of the preferred embodiments thereof in connection with the attached drawings.

BRIEF DESCRIPTION OF THE DRAWINGS

The foregoing features and other features of the disclosure will now be described with reference to the drawings of various objects of the disclosure. The illustrated embodiment is intended to illustrate, but not to limit the disclosure. The drawings include the following.

DETAILED DESCRIPTION OF THE PREFERRED EMBODIMENTS

The disclosure provides a reflector antenna and a method for shaping an antenna beam. To facilitate a better understanding of the preferred embodiment, the general architecture and operation of a GPS satellite antenna will be described. The specific architecture and operation of the preferred embodiment will then be described with reference to the general architecture.

Figure 1:
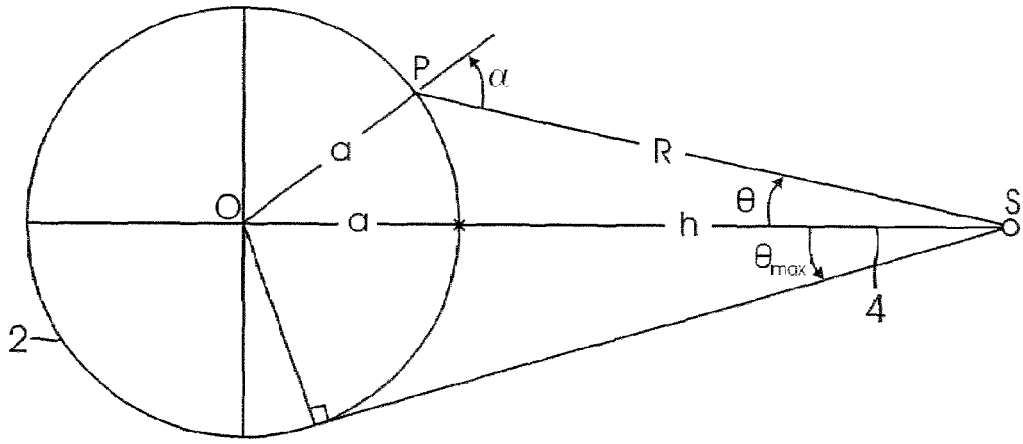
FIG. 1 shows a GPS satellite in orbit around earth.

FIG. 1 shows the GPS satellite, S, in orbit around the earth 2, with a center O. The distance from GPS satellite S to a geo-location P, or range R, is derived as a function of angle θ, where θ is measured from the center line 4. Range R is shortest at the center line and gradually increases toward the "visible edge" of earth 2. A longer range results in more space loss as the space loss is proportional to the square of the range. In other words, if an RF signal travels a longer distance, the power density of the signal decreases. Therefore, without a properly shaped antenna pattern, the power radiated from GPS satellite, S, is not constant at every location on earth 2. At any point P, the range R is given by $$R=(a+h)\cos\theta-\sqrt{((a+h)^2\cos^2\theta-h(2a+h))} \quad (1)$$

Where the Earth radius a=6,366 km and

Satellite altitude, h=20,200 km.

The θ value is zero along the center line and has a maximum value of $\theta_{max}$=13.87° at the "visible edge" of the earth.

The angle α is a signal incidence angle onto a horizontally laid GPS receiver antenna on a geo-location and varies due to the curvature of the earth. It should be noted that values of a range from 0° at the centerline 4 to $\alpha_{max}$=89.92° at the "visible edge" of earth 2.

Figure 2:
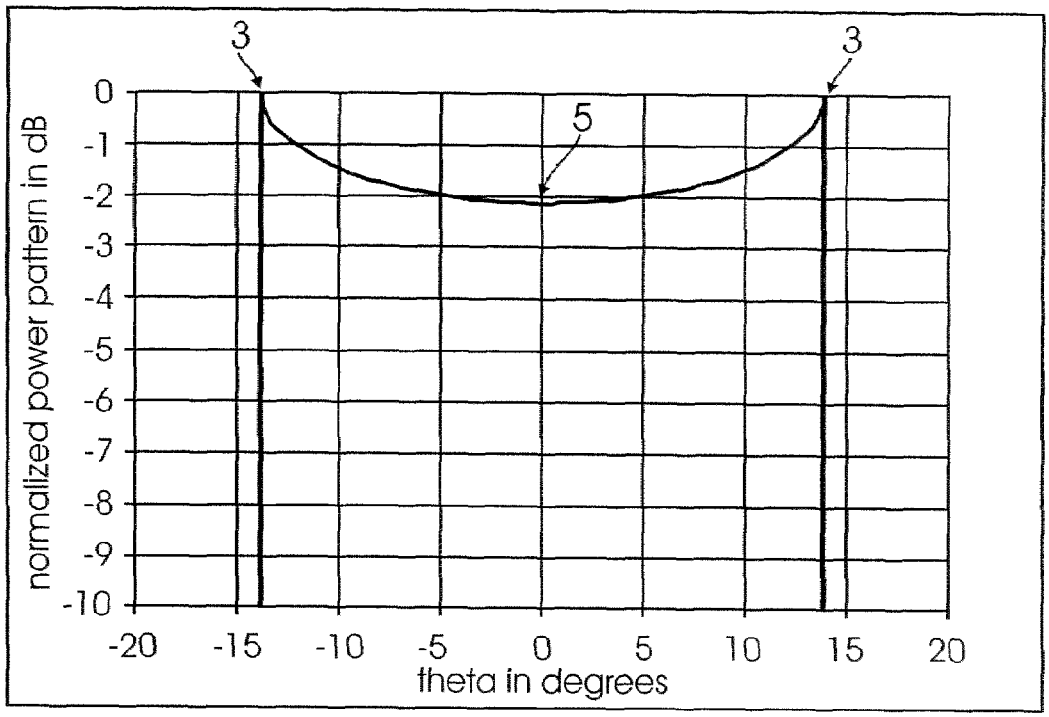
FIG. 2 shows a graph of a desired antenna pattern.

When a constant power level is desired everywhere on earth, the gain pattern of a transmitting antenna on a GPS satellite should be made proportional to the square of the range to compensate for space loss, i.e. $G_t(\theta)\propto R^2(\theta)$. When range R in equation (1) is rendered on a normalized dB scale, the desired GPS satellite antenna pattern results, as shown in FIG. 2. The antenna pattern in FIG. 2, hereinafter referred to as an "M-shaped pattern", is rotationally symmetric and is similar to the inside of a bowl. The peak gain is achieved along rim 3. The M-shaped pattern is tapered toward the center producing a 2.1 dB dip at its center 5. The region outside of the 27.74° beamwidth ($2\theta_{max}$) is beyond the "visible edge" of Earth 2, and does not require any radiated power. To achieve the M-shaped pattern, GPS satellites use an expensive array antenna fed by a corporate beam-forming network (not shown).

Figure 3A:
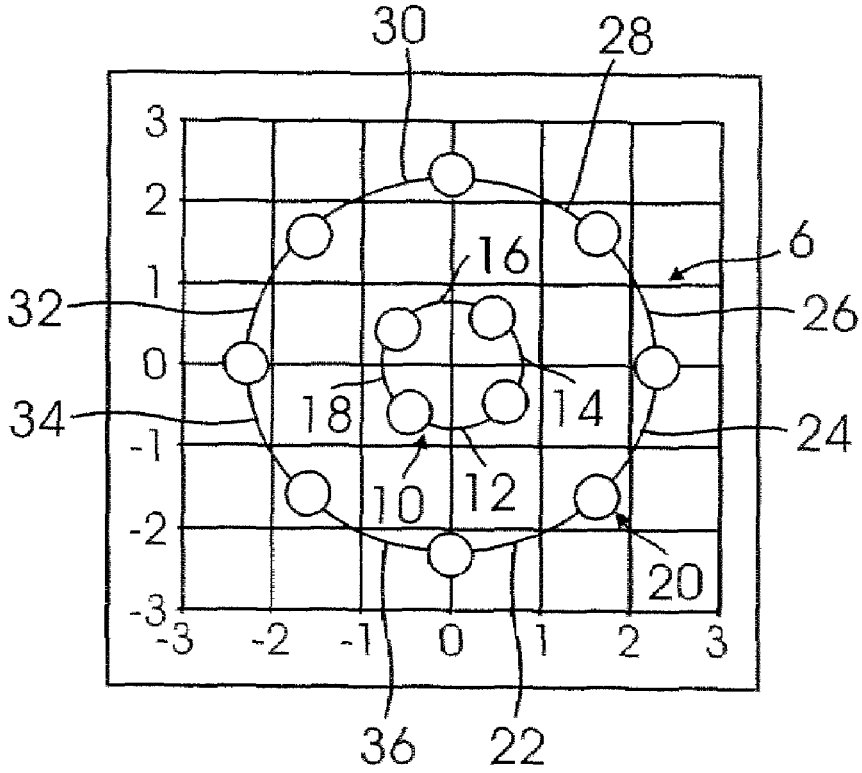
FIG. 3*a* shows a top view of a multi-element antenna array configuration for GPS satellites.
Figure 3B:
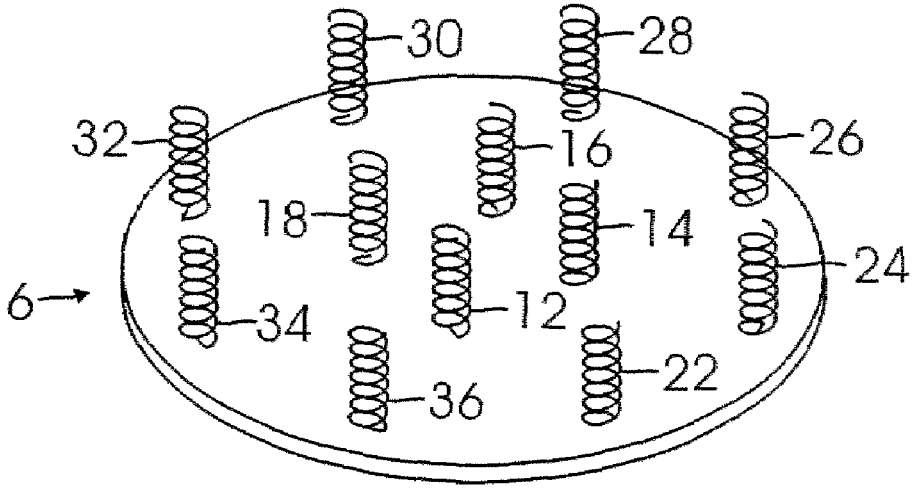
FIG. 3*b* shows an isometric view of the multi-element antenna array configuration shown in FIG. 3*a;*

Conventional GPS satellite antenna arrays use multiple radiating elements. FIG. 3*a* shows a top view of a conventional antenna with a twelve radiating element array 6. FIG. 3*b* shows an isometric view of twelve element array 6. Array antenna 6 is comprised of an inner ring 10 of four helix elements 12-18 and an outer ring 20 of eight helix elements 22-36. The beam-forming network divides power to feed the twelve radiating elements or array 6. Inner ring elements 12-18 are fed in the middle and power is diverted from the network and bifurcated, exciting outer ring elements 22-36. As a result, both inner ring 10 and outer ring 20 are excited at the same time. (current distribution in a ring grid array exhibits circular symmetry.) Exciting inner ring 10 generates a main beam while exciting outer ring 20 at reduced power (10% of the power applied to the outer ring) at almost out-of-phase, defocuses the main beam resulting in a broad main beam with a dip in the middle.

When a GPS satellite antenna pattern, as shown in FIG. 2, is attempted over a range of frequencies, L1=1.5754 GHz, L2=1.2276 GHz, L3=1.3811 GHz, and L5=1.1765 GHz, for a given aperture size, the L1 beam is the narrowest and the L5 beam is the widest. Thus, this idealized M-shaped beam for $-\theta_{max} \leqq \theta \leqq \theta_{max}$ can not be met at all frequencies and the signal intensity varies with frequency where the GPS receiver is located.

A conventional antenna system comprising of twelve helix radiating elements and a power distribution network, as shown in FIG. 3*a*, is expensive due to the number of array elements and the complexity of the network. The discrete nature of the aperture distribution makes the array antenna inefficient over the frequency band and the complexity of the power feed network also contributes to a high insertion loss and a limited bandwidth. Furthermore, inaccuracy of amplitude and phase values delivered to each radiating element creates additional losses.

In an aspect of the disclosure, a single helix feed reflector antenna is provided. The single helix feed antenna illuminates two co-focal, stacked dishes (described below with reference FIG. 4*a*). The stack dishes produce a GPS satellite pattern similar to the pattern shown in FIG. 2 over a frequency band encompassing the range of frequencies from L1 to L5.

Unlike a conventional array antenna, reflector antenna 39 of the disclosure (shown in FIG. 4*a*) does not use an array of multiple elements, a wideband beam-forming network, or any wideband power dividers. As a result, reflector antenna 39 of the disclosure is simple, compact, sturdy, lightweight, robust in performance, and inexpensive to fabricate.

Figure 4A:
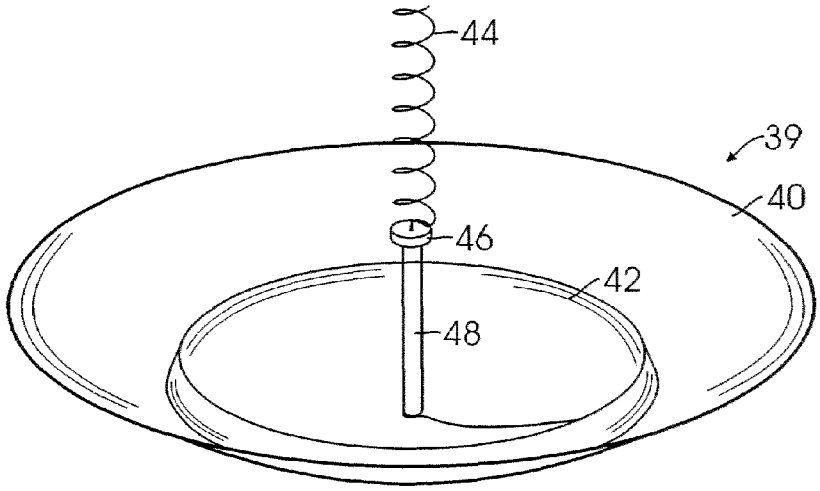
FIG. 4*a* shows an antenna, according to one aspect of the disclosure.

FIG. 4*a* shows antenna 39 (hereinafter referred to as "reflector antenna 39"), according to one aspect of the disclosure. Reflector antenna 39 comprises an inner dish 40 and a outer dish 42, each having a parabolic surface and where outer dish 42 has a larger diameter than inner dish 40. As described above, inner dish 42 and outer dish 40 are stacked together creating an antenna reflector with two stacked co-focal parabolic dishes. Inner dish 42 and outer dish 40 are roughly separated by quarter wavelengths at the center frequency and may be held together by using known conductive adhesive or fasteners that are known in the art.

Figure 4B:
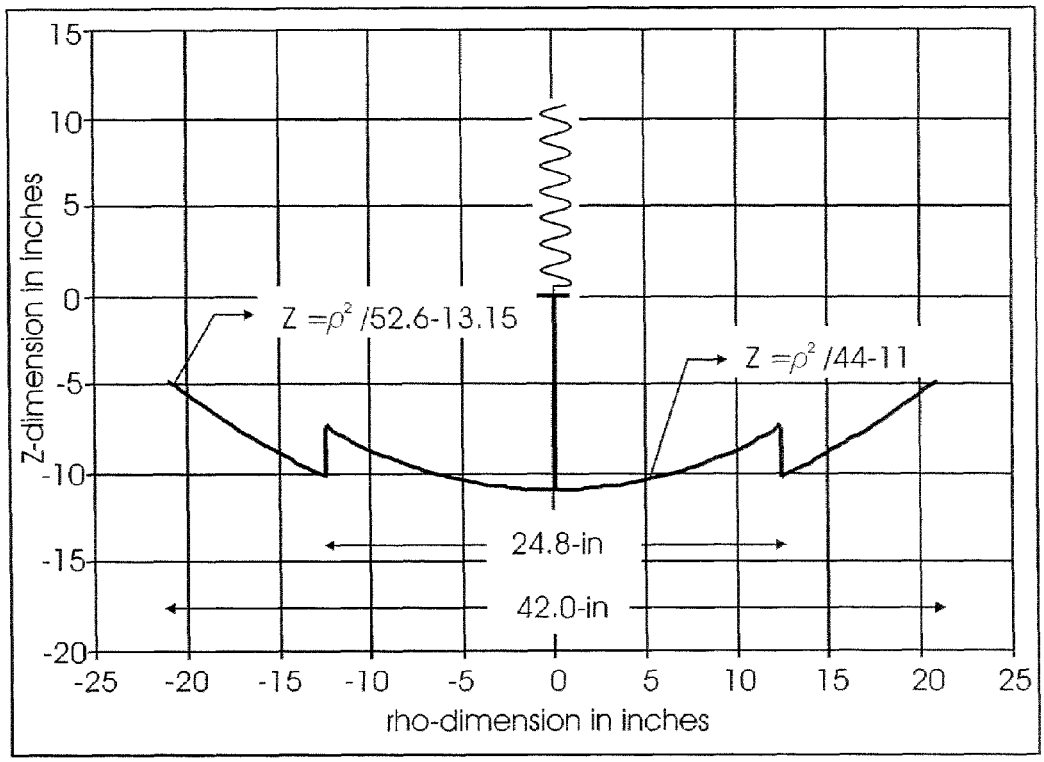
FIG. 4*b* shows an example of antenna dimensions, according to one aspect of the disclosure.

The dimensions and separation of dishes 42, 40 are optimized to produce the M-shaped pattern, shown in FIG. 2, over a wide frequency range, for example, frequencies ranging from L1 through L5. In one aspect of the disclosure, as shown in FIG. 4*b*, the diameter of outer dish 40 may be 42 inches with a focal length of 13.1 inches, and the diameter of inner dish 42 may be 24.6 inches with a focal length of 11 inches.

The feed of reflector antenna 39 may be a circular polarization backfire monofilar helix 44 with a ground plane 46, for backfiring. Ground plane 46 is mounted on a support 48 located on the axis of reflector antenna 39 at the co-focal point of inner dish 42 and outer dish 40 for optimal results. The optimized ground plane 46 incurs efficient backfiring from the helix feed and has an additional benefit of small aperture blockage. Aperture blockage is normally due to shadowing by the feed, subreflector and/or support members.

Although the disclosure is described using a monofilar helix, those skilled in the art will recognize that the principles and teachings described herein may be applied to a variety of antenna feeds, including, but not limited to, horn feed, splash plate feed, bifilar and quadrifilar feeds.

In one aspect of the disclosure, reflector antenna 39 with a single feed can handle all the radiated power. In one aspect, a heavy duty helix antenna design, i.e. utilizing a thick wire, may be used to improve power handling capability.

In a second aspect, a backfire quadrifilar helix with feed currents in quadrature may be used. The multiple feed points of a quadrifilar helix feed may provide the ability to handle more power. Furthermore, a quadrifilar helix feed may improve pattern symmetry.

Figure 4C:
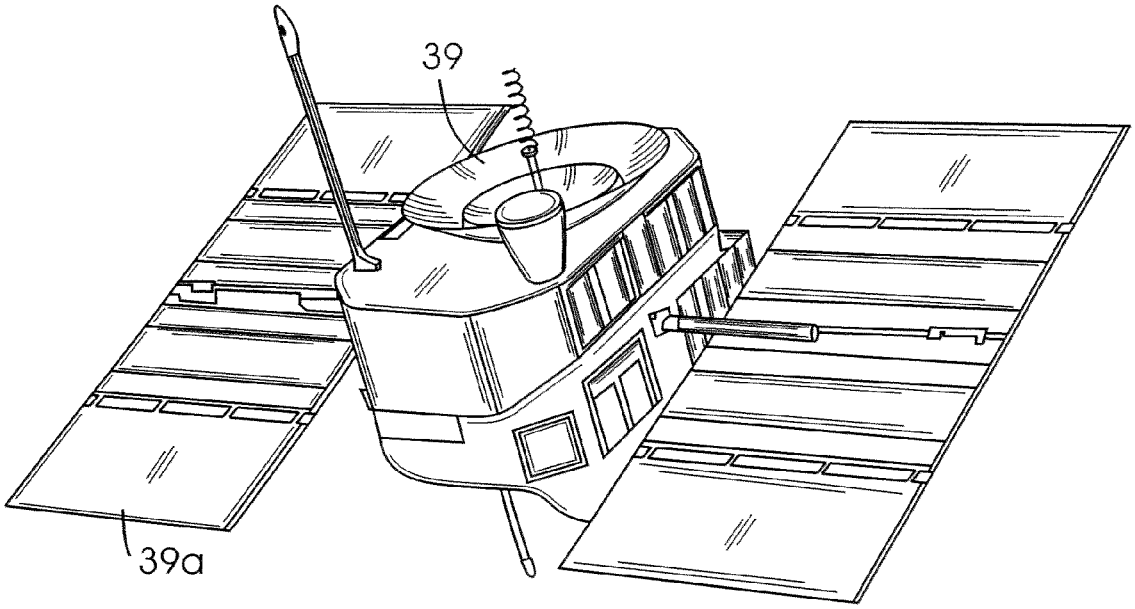
FIG. 4*c* shows an example of an antenna on a GPS satellite, according to one aspect of the disclosure.

FIG. 4*c* shows an example of reflector antenna 39 used on a GPS satellite 39A, according to one aspect of the disclosure.

Figure 5:
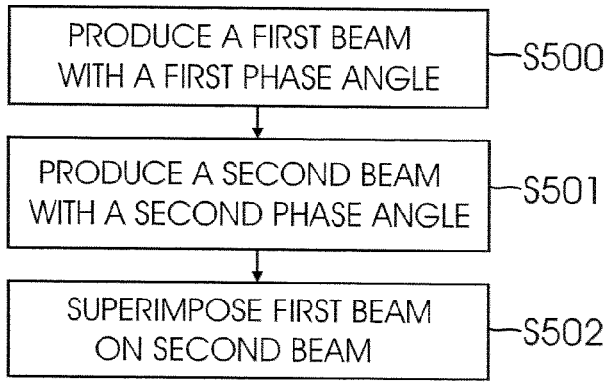
FIG. 5 shows the process steps for shaping an M-shaped antenna beam using the antenna of the disclosure.

FIG. 5 shows process steps for shaping an antenna beam using reflector antenna 39 of the disclosure. In step S500, a first beam having a first phase angle is produced by backfire helix 44 reflecting signals off outer reflector 40. In step S501, a second beam having a second phase angle, which is different from the first phase angle, is produced by backfire helix 44 reflecting signals off inner reflector 42. In step S502, the first and second beams are superimposed to generate a pattern similar to the M-shaped beam pattern shown in FIG. 2.

Figure 6:
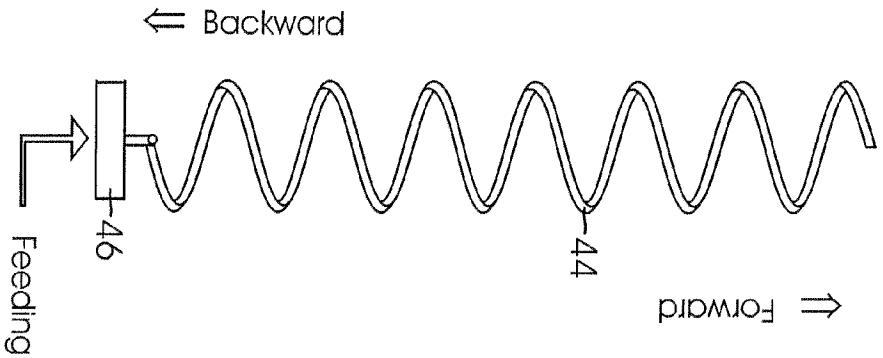
FIG. 6 shows an example of a backfire monofilar helix used on an antenna, according to one aspect of the disclosure.

In order to minimize blockage, a backfire circular polarization feed on ground plane 46 is utilized, as shown in FIG. 6. In one aspect of the disclosure, the helix feed design has a diameter of 2.3 inches. Furthermore, in one aspect, reflector aperture diameter is 42 inches which results in minimal blockage by ground plane 46 of a diameter of 2.07 inches and improved performance in terms of gain, axial ratio, back-to-front ratio, and frequency beamwidth over 30% encompassing a wide range of frequencies, for example L1 through L5. Any suitable dimensions may be used for helix 44 and ground plane 46. An example is provided in FIG. 6 for illustrative purposes only. It is noteworthy that the adaptive aspects of the disclosure are not limited to any particular dimensions.

The L-band signal of a GPS satellite typically has right hand circular polarization (RHCP). For a conventional array antenna, each radiating helix element is RHCP. However, for reflector antenna 39, the feed illuminates reflector antenna 39 with the left hand circular polarization (LHCP) waves as a result of the feed being reflected off inner dish 42 and outer dish 40, the wave polarization changes to RECP. In addition, the helix is wound in the counter clock-wise (CCW) sense so that the forward radiation is RHCP, while the backward radiation is LHCP. The backfire helix for a reflector feed is similar to a forward fire helix antenna, except for the size of ground plane 46. In addition, if the helix is wound in the clock-wise (CW) sense, the forward radiation is LHCP, while the backward radiation is RHCP.

Figure 7:
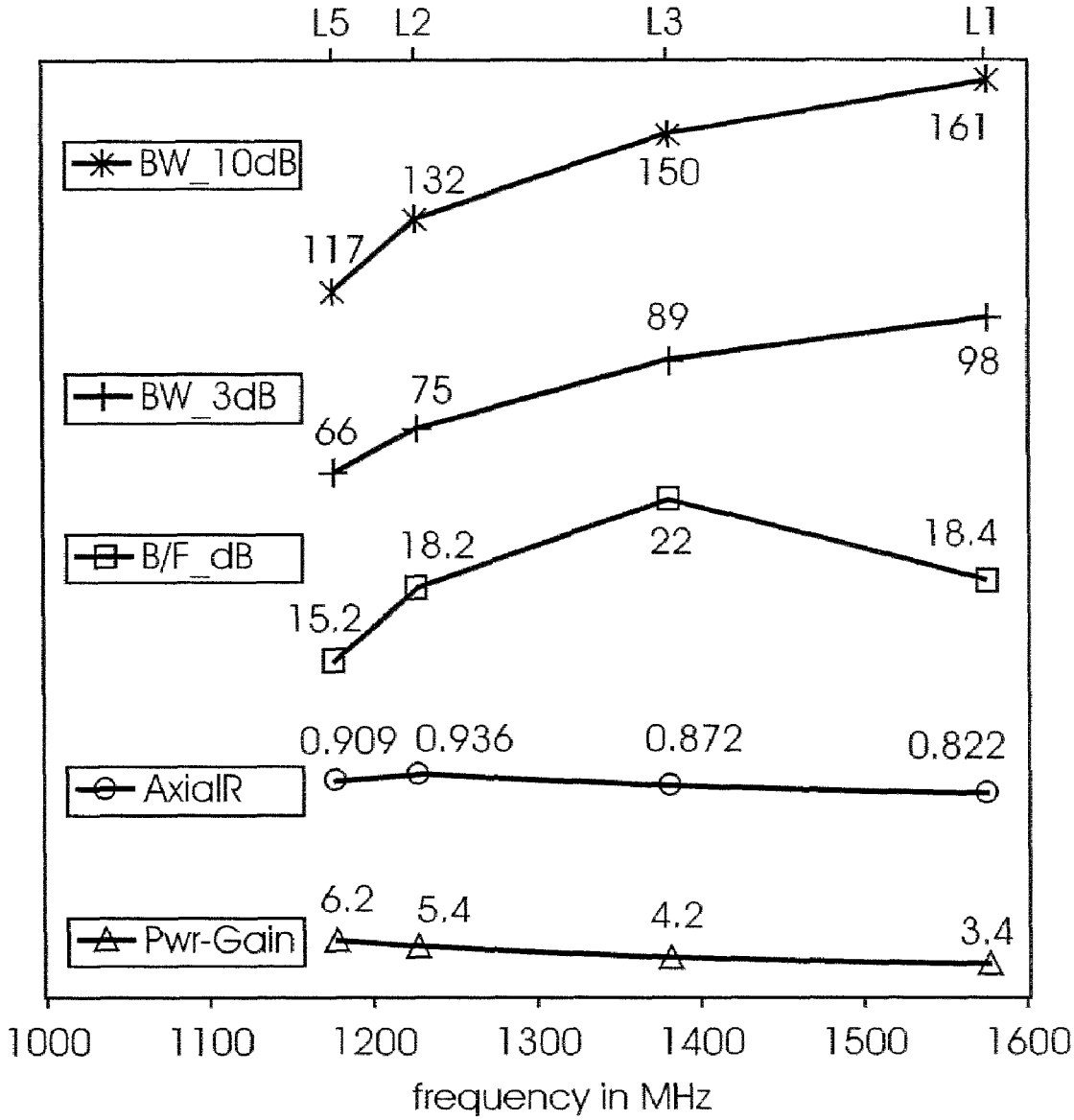
FIG. 7 is a graph showing the performance curves at various frequencies of the backfire helix feed that is shown in FIG. 6.
Figure 8A:
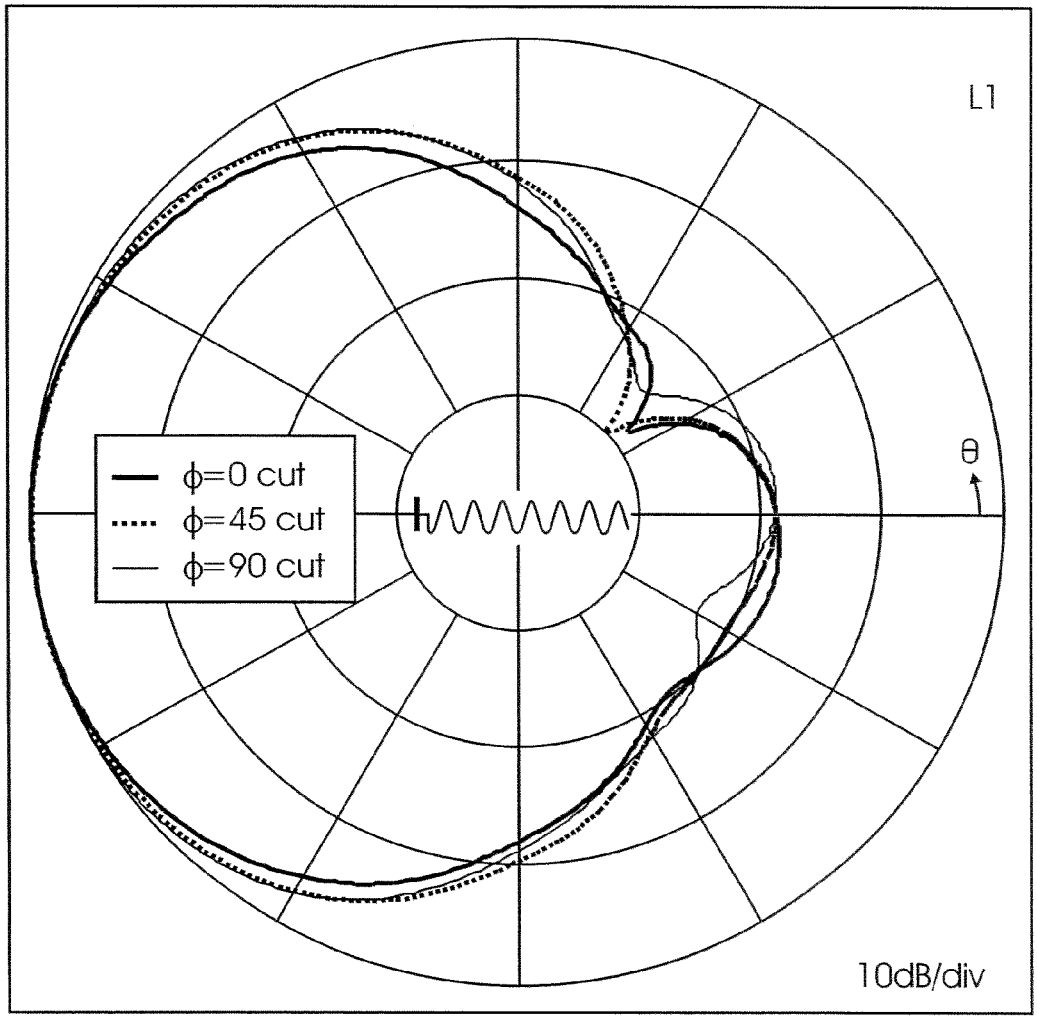
FIGS. 8*a*–8*d* show backfire monofilar helix patterns at various frequencies, according to one aspect of the disclosure.
Figure 8B:
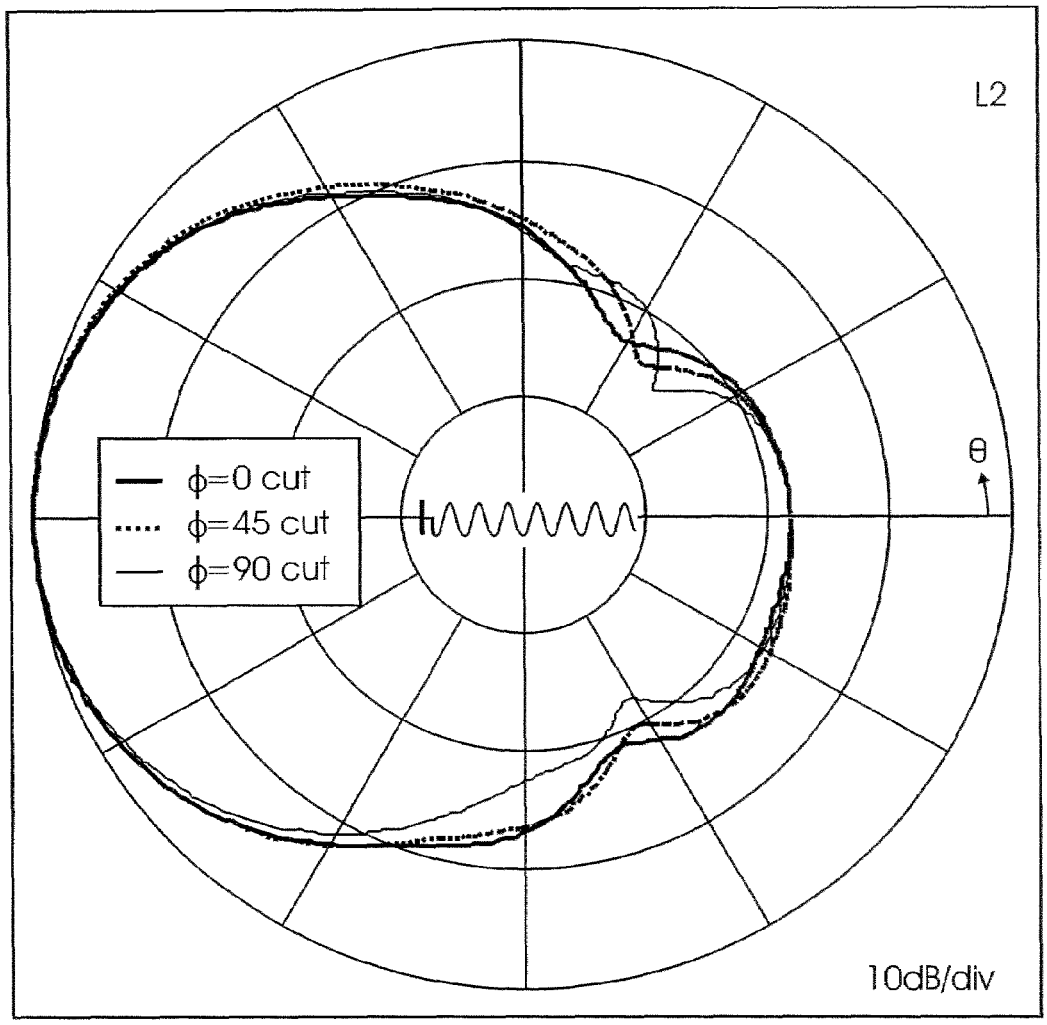
Figure 8C:
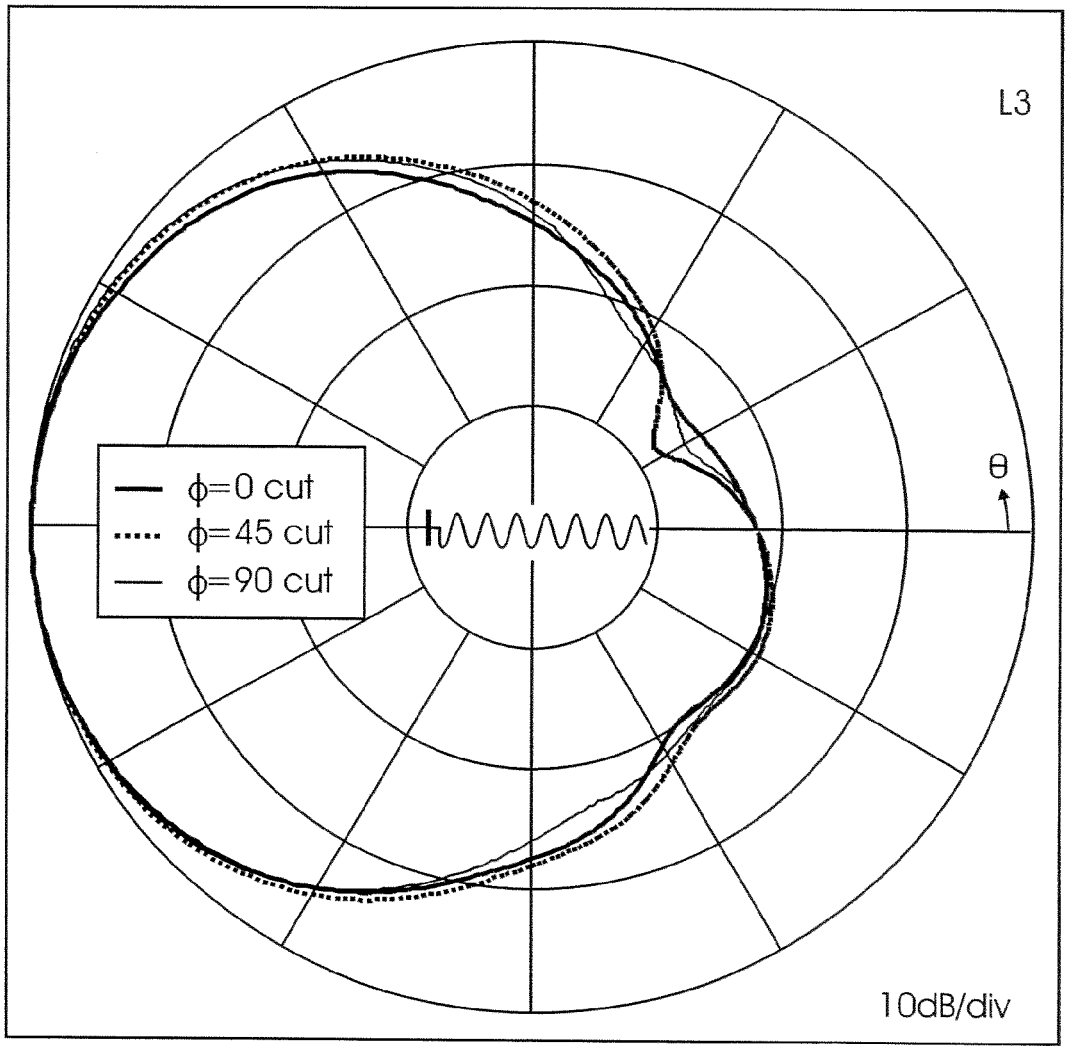
Figure 8D:
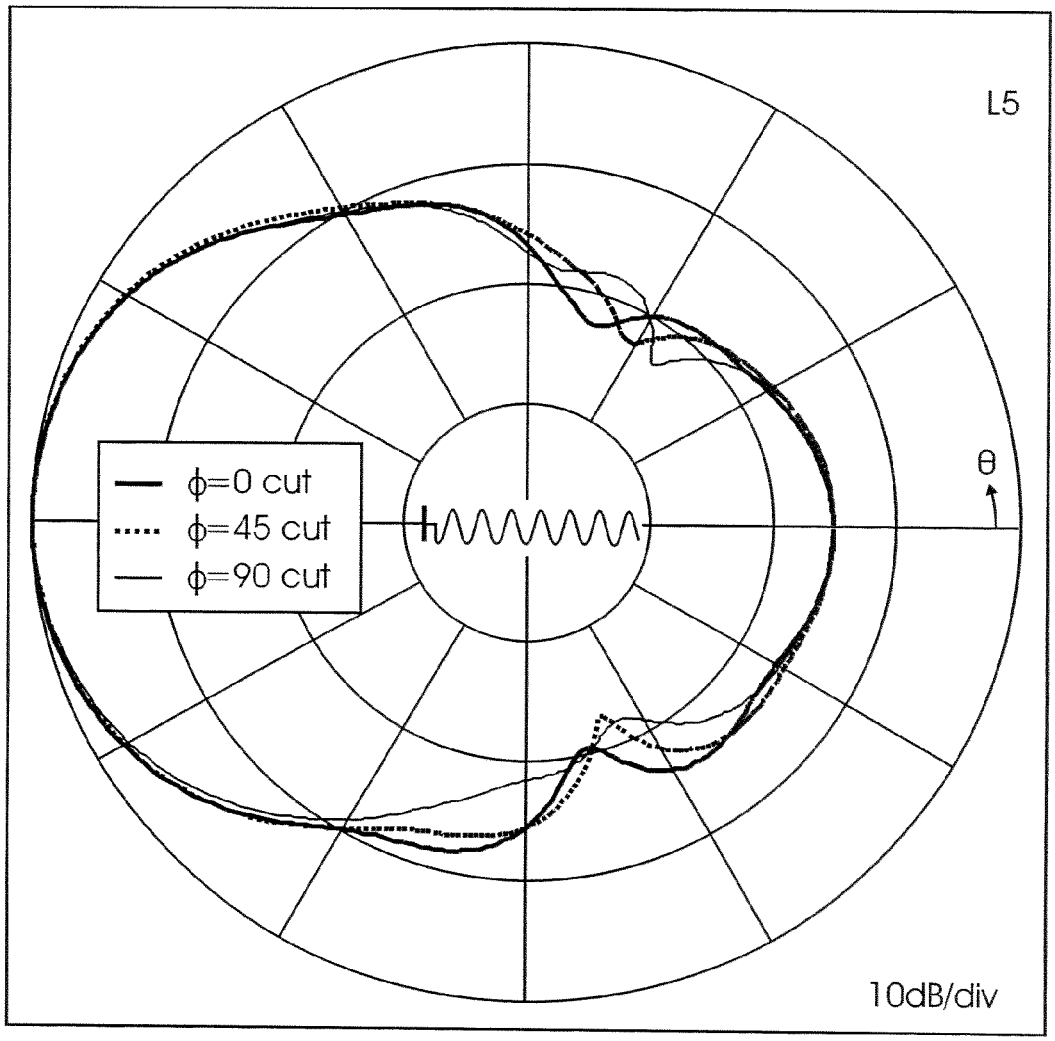
Figure 9A:
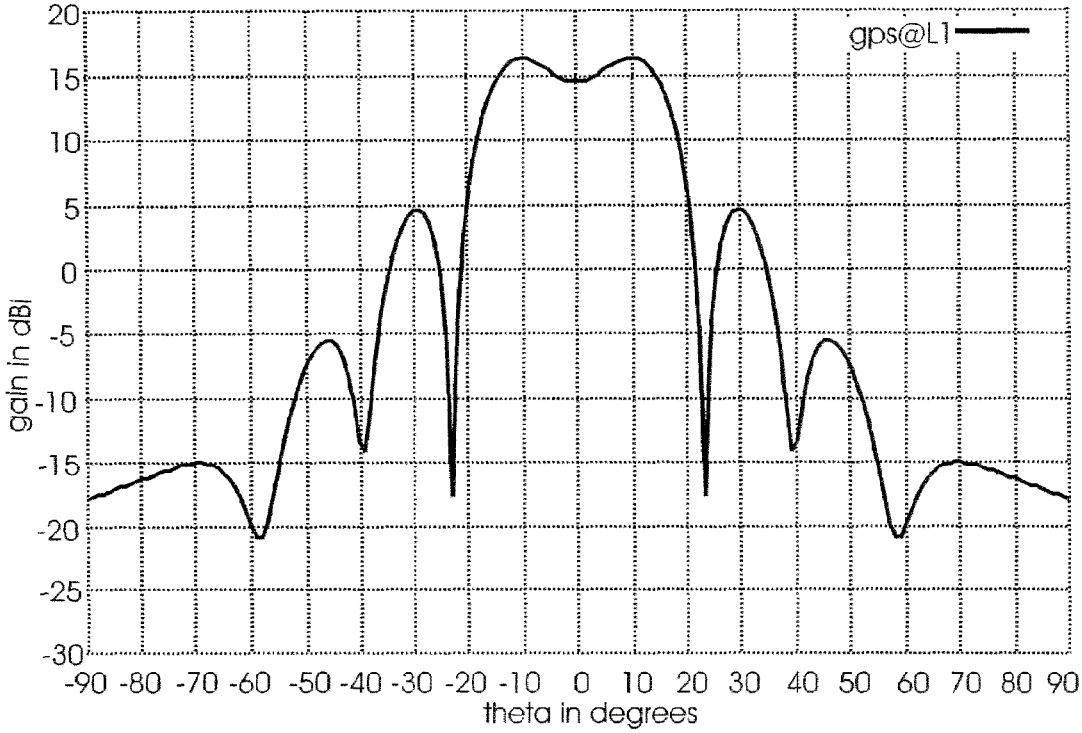
FIGS. 9*a*-9*d* show reflector antenna patterns at various frequencies, according to one aspect of the disclosure.
Figure 9B:
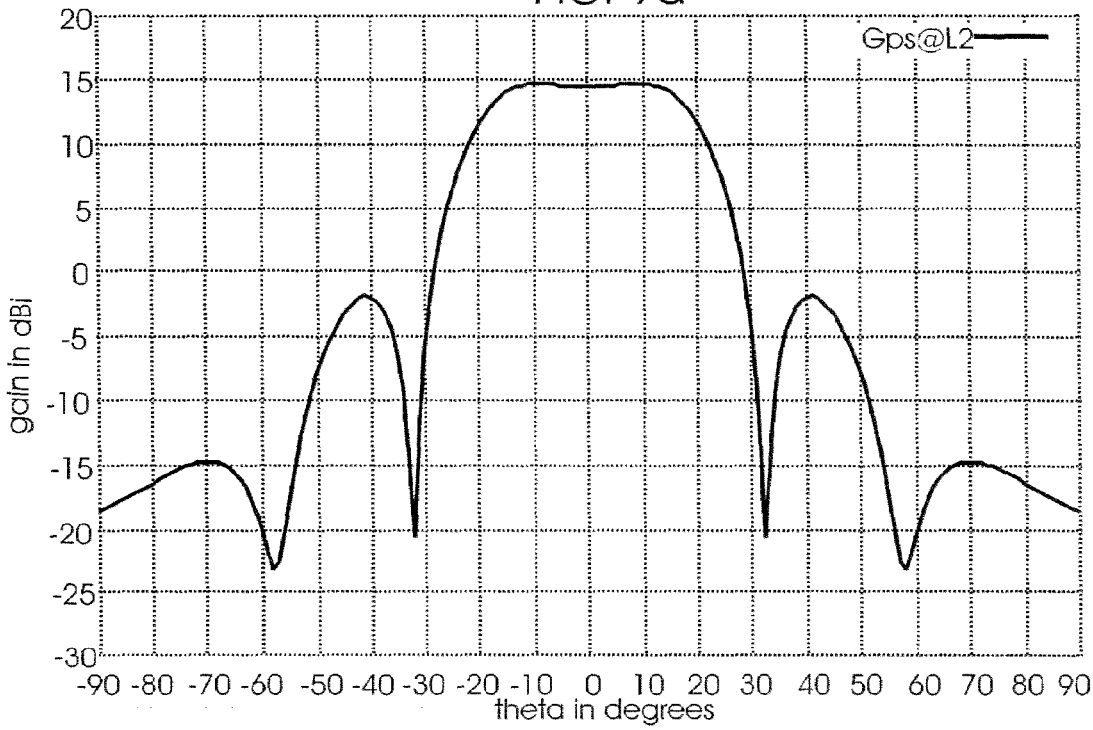
Figure 9C:
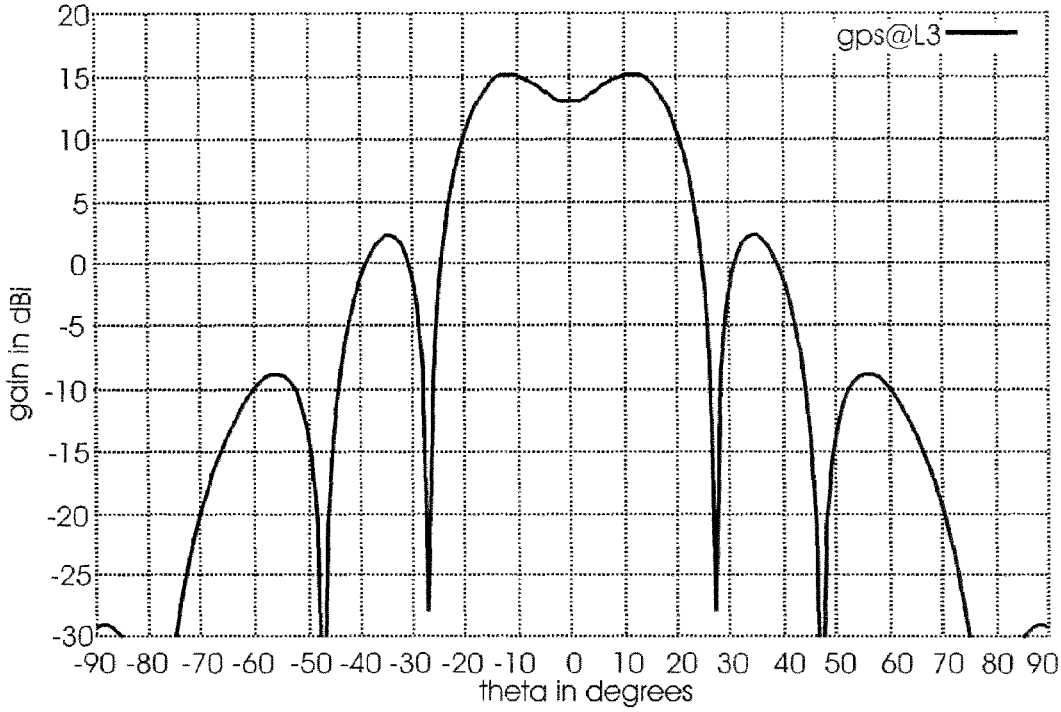
Figure 9D:
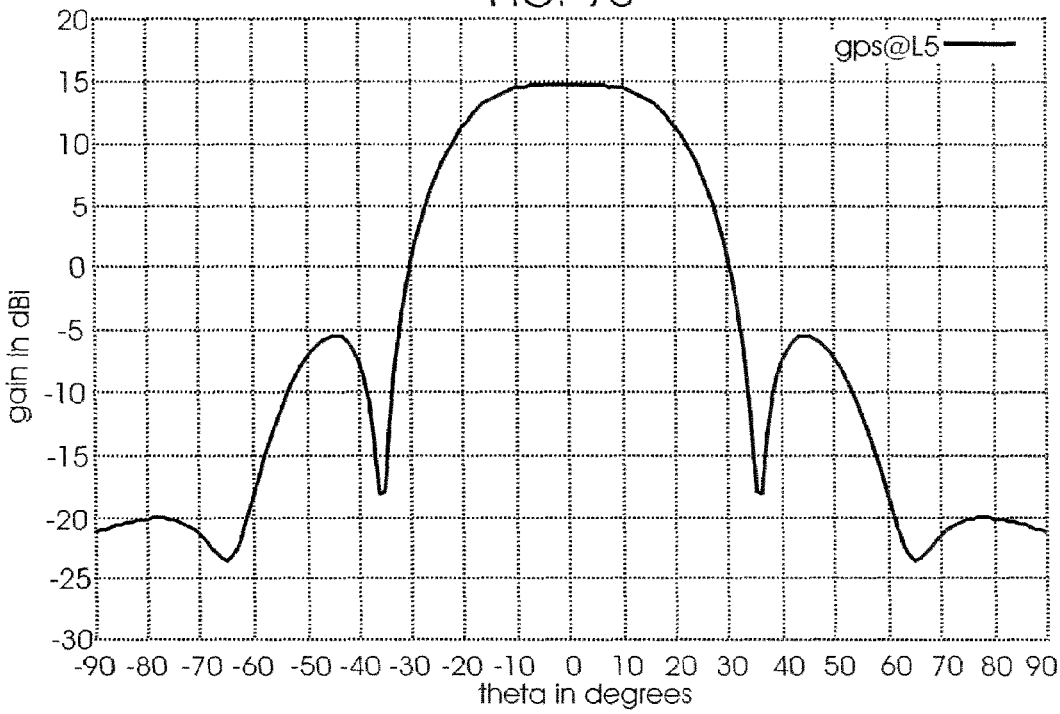

FIG. 7 graphically illustrates helix antenna performance curves of gain in dBi, axial ratio, back to front ratio in dB, 3 dB beamwidth in degrees, and 10 dB beamwidth in degrees at frequencies L1, L2, L3 and L5 using helix 44 of FIG. 6.

FIGS. 8*a*-8*d* show the backfire monofilar helix patterns at frequencies L1, L2, L3 and L5 according to one aspect of the disclosure. As can be seen in these figures, back firing capability with respect to forward firing over the frequency band is improved over conventional designs. It should be noted that when the back to front ratio is 20 dB, over 99% of the feed radiated power is toward the dishes and reflected to form the M-shaped far-field pattern on the earth.

FIGS. 9*a*-9*d* show reflector antenna patterns at frequencies L1, L2, L3 and L5 plotted versus θ when reflector antenna 39 is fed by the helix feed pattern in FIGS. 8*a*-8*d*, respectively. The main lobe of the reflector antenna pattern at the L5 frequency (see FIG. 9*d*) attains a maximum value at the center (θ=0°) and then slowly decreases as θ approaches $\theta_{max}$=13.87°. This phenomenon is attributed to the fact that the helix feed pattern at L5 is high in gain.

Reflector antenna 39, fed by a backfire LHCP monofilar helix feed, can produce a GPS satellite-specific beam over various frequencies, for example. L1 through L5 frequencies at RHCP. Furthermore, reflector antenna 39 is simpler, compact, sturdy, economically feasible, and robust in performance over existing designs. It demonstrates optimal performance in regard to beam shape, gain, axial ratio, and back-to-front ratio over the 30% frequency bandwidth while delivering substantially improved beam shaping capability. Furthermore, the antenna system of the disclosure can significantly reduce cost over the existing multi-element GPS satellite array antenna systems.

Reflector antenna 39 is not limited to GPS satellites and can be applied to DirecTV®, Mobile Communication Satellites, and other various communication satellites where an M-shaped beam or any modified M-shaped beam is required. For GPS satellite applications, the reflector shape is circular. However, for an arbitrarily shaped contour beam, the boundaries of the inner and outer dishes 42, 40 are properly shaped and can be arbitrary.

In summary, the disclosure provides a reflector antenna fed by a backfire LHCP monofilar helix feed producing a RHCP GPS satellite-specific beam over a wide frequency range, for example, L1 through L5 frequencies. The reflector antenna provides robust antenna beam shaping capability over a wide band. The use of the continuous aperture of the antenna, combined with minimal feed blockage and minimal feed insertion losses results in a highly efficient shaped beam antenna with high gain. Furthermore, as a result of the simple feeding structure, the operating frequency bandwidth is wider than conventional antennas.

Although reflector antenna 39 of the disclosure is implemented using GPS satellites, those skilled in the art will recognize that the principles and teachings described herein may be applied to a variety of platforms including communication satellites, terrestrial communication systems, and Radar systems to name a few. Furthermore, reflector antenna 39 is not limited to a helix feed and may be used for any type of feed or an array of feed including horn, dipole, slot, patch and splash plate antennas.

While the disclosure is described above with respect to what is currently considered its preferred embodiments, it is to be understood that the disclosure is not limited to that described above. To the contrary, the disclosure is intended to cover various modifications and equivalent arrangements within the spirit and scope of the appended claims.

What is claimed is:

1. An antenna, comprising:

an outer dish having a first surface and a second surface;

an inner dish mounted to the first surface of the outer dish;

a helix feed mounted on a ground plane: and a support mounted at an axial center of the inner dish for supporting the ground plane, wherein the inner dish has a parabolic shape.

2. The antenna of claim 1, wherein the outer dish is larger than the inner dish.

3. The antenna of claim 1, wherein the helix feed backfires and illuminates the inner and outer dishes with circular polarization waves.

4. The antenna of claim 1, wherein the helix feed comprises a helix having a counter clock-wise winding rotation wherein a backward radiation is left hand circular.

5. The antenna of claim 4, wherein the wave polarization changes to right hand circular polarization after being reflected off the inner and outer dishes.

6. The antenna of claim 1, wherein the helix feed comprises a helix having a clock-wise winding rotation wherein a backward radiation is right hand circular.

7. The antenna of claim 6, wherein the wave polarization changes to left hand circular polarization after being reflected off the inner and outer dishes.

8. The antenna of claim 1, wherein the outer dish has a parabolic shape.

9. The antenna of claim 1, wherein the first and second surfaces of the outer dish are metallic.

10. The antenna of claim 1, wherein the inner dish is metallic.

11. The antenna of claim 1, wherein the ground plane is metallic.

12. The antenna of claim 1, wherein the helix feed facilitates minimal blockage.

13. The antenna of claim 1, wherein the helix feed is selected from the group consisting of monofilar, bifilar and quadrifilar.

14. An antenna, comprising:

an outer dish having a first surface and a second surface;

an inner dish mounted to the first surface of the outer dish;

a helix feed mounted on a ground plane; and a support mounted at an axial center of the inner dish for supporting the ground plane, wherein the reflector antenna produces a first beam and a second beam at different phase angles; and an M-shaped antenna pattern is produced when the first and second beams are superimposed.

15. A method for shaping an antenna beam, comprising:

producing a first beam having a first phase angle, wherein the first beam is generated from signals reflected off an inner dish of a reflector antenna;

producing a second beam having a second phase angle, wherein the second beam is generated from signals reflected off an outer dish; and superimposing the second beam on the first beam resulting in an M-shaped beam pattern.

16. The method of claim 15, wherein the first phase angle is different than the second phase angle.

17. The method of claim 15, wherein the helix feed of the first beam and the second beam are generated using a monofilar, bifilar or quadrifilar feed.

18. The method of claim 15, wherein the outer dish and the inner dish each have a parabolic surface.

19. The method of claim 15, wherein the helix feed comprises a helix having a counter clock-wise winding rotation; and a forward radiation is right hand circular polarization.

20. The method of claim 15, wherein the helix feed comprises a helix having a clock-wise winding rotation; and a forward radiation is left hand circular polarization.

21. The method of claim 15, wherein a helix feed mounted is on a ground plane; and wherein a support is mounted at an axial center of the inner reflector for supporting the ground plane.

22. The method of claim 15, wherein the size and distance between the inner dish and the outer dish and the helix feed generate an M-shaped beam.

* * * * *